US006631975B2

(12) United States Patent
Fukasawa et al.

(10) Patent No.: US 6,631,975 B2
(45) Date of Patent: Oct. 14, 2003

(54) INK JET RECORDING APPARATUS AND METHOD OF CONTROLLING WIPING OPERATION OF RECORDING HEAD IN THE INK JET RECORDING APPARATUS

(75) Inventors: Shigenori Fukasawa, Nagano (JP); Atsushi Yoshida, Nagano (JP)

(73) Assignee: Sekio Epson Corporation, Tokyo (JP)

( * ) Notice: Subject to any disclaimer, the term of this patent is extended or adjusted under 35 U.S.C. 154(b) by 36 days.

(21) Appl. No.: 10/091,420

(22) Filed: Mar. 7, 2002

(65) Prior Publication Data

US 2002/0140767 A1 Oct. 3, 2002

(30) Foreign Application Priority Data

Mar. 8, 2001 (JP) ..... P2001-064389

(51) Int. Cl.[7] ..... B41J 2/165
(52) U.S. Cl. ..... 347/33
(58) Field of Search ..... 347/8, 22, 29, 347/30, 33, 23, 37; 400/55, 59, 56, 58, 355

(56) References Cited

U.S. PATENT DOCUMENTS 6,000,775 A 12/1999 Muraki ..... 347/8
6,315,468 B2 * 11/2001 Kishida et al. ..... 400/55

FOREIGN PATENT DOCUMENTS

JP 11-115275 A 4/1999

OTHER PUBLICATIONS

European Search Report EP 02004374, Bridge, S. Apr. 4, 2002.

* cited by examiner

*Primary Examiner*—Shih-wen Hsieh
(74) *Attorney, Agent, or Firm*—Sughrue Mion, PLLC

(57) ABSTRACT

A position of a nozzle forming surface 15*a* of a recording head is varied by an adjusting operation of a platen gap. Accordingly, an amount of interference (L1, L2) of a wiping member (11), which wipes the nozzle forming surface (15*a*), against the nozzle forming surface (15*a*), varies. With this, a sliding contact of the wiping member (11) against the nozzle forming surface (15*a*) varies. When the platen gap is large, the wiping effect decreases. Accordingly, when the platen gap is large, the wiping speed is decreased, and the decrease of the wiping effect is compensated for by increasing the number of wiping operations.

11 Claims, 6 Drawing Sheets

INK JET RECORDING APPARATUS AND METHOD OF CONTROLLING WIPING OPERATION OF RECORDING HEAD IN THE INK JET RECORDING APPARATUS

CROSS REFERENCE TO RELATED APPLICATIONS

The present application is based on Japanese Patent Application No. 2001-64389, the entire contents of which are incorporated herein by reference.

BACKGROUND OF THE INVENTION

The present invention relates to an ink jet recording apparatus having an ink jet recording head, mounted on a carriage to be reciprocatively moved, for ejecting ink droplets in accordance with print data. More particularly, the invention relates to an ink jet recording apparatus in which an operation mode of the wiping operation is changed in accordance with an amount of adjustment of a platen gap, which is carried out by a platen gap adjusting device, and a method of controlling the operation of wiping a recording head in the ink jet recording apparatus.

An ink jet recording apparatus based on the serial printing system includes an ink jet recording head, which is mounted on a carriage and moved in a main scan direction, and a paper feeding device for feeding a recording sheet in a sub-scan direction perpendicular to the main scan direction. The recording head ejects ink droplets onto a recording sheet in accordance with print data, and prints images on the recording sheet.

The ink jet recording head prints images on a recording sheet in a manner that ink is pressurized in the pressure generating chamber, and is ejected in the form of ink droplets from the nozzle orifices toward the recording sheet. Therefore, the nozzle orifices are frequently clogged, and this results in improper printing. Various causes of the nozzle clogging exist, and examples of them are increase of ink viscosity due to solvent evaporation through the nozzle orifices, ink solidification, and dust attaching to the orifices.

To avoid the clogging trouble, this type of the ink jet recording apparatus uses a capping device for hermetically closing the nozzle forming surface of the recording head in a non-print mode. The capping device serves as a lid for preventing the ink at the nozzle orifices of the recording head from being dried. Further, it functions to recover the ink droplets ejection capability of the recording head. That is, when the nozzle orifices are clogged, the nozzle forming surface is sealed with the capping device, a negative pressure is applied from a suction pump to the clogged nozzle orifices to forcibly suck the ink therefrom. In this way, the clogging of the nozzle orifices is removed.

A process of forcibly sucking the ink from the clogged nozzle orifices, which is executed for removing the clogging of the recording head, is called a cleaning operation. It is executed when the printing is started again after the ink jet recording apparatus is not used for a long term or when the user recognizes printing failure and operates a cleaning switch, for example. In the cleaning operation, under a negative pressure by the suction pump, the ink is sucked and discharged into the capping device from the recording head, and then the nozzle forming surface is wiped with a strip-like wiping member formed of a rubber material, for example.

By executing the wiping operation, the ink that is attached to the nozzle forming surface of the recording head by the cleaning operation is wiped out from the nozzle forming surface, thereby solving the problem that ink falls in droplets from the recording head. By executing the wiping operation, meniscuses formed at the nozzle orifices are reshaped, whereby the ejection of ink droplets from the recording head is stabilized, and highly precise printing is guaranteed.

This type of ink jet recording apparatus is provided with a platen gap adjusting device which adjusts a gap between a recording head and platen for guiding the recording sheet in accordance with a thickness of the recording sheet used for printing. Most of the platen gap adjusting devices are each designed such that when the device is operated, the recording head is moved with respective to the platen fixed.

In particular, in recent years, with diversification of printing, there is an increase of the market demand of using a relatively thick recording sheet for the printing sheet. With such a market demand, the necessity for the considerably increasing of an adjustable range of the gap adjustment by the platen gap adjusting device, when comparing with the conventional one, is present. In this circumstance, a movable range of the recording head when the platen gap adjusting device is operated is more and more increasing.

The wiping member is held with a wiper holder such that it is movable, for example, horizontally and to and from a movement path of the recording head. To the wiping operation, the wiping member advances to the movement path of the recording head, the tip of it comes in sliding contact with the nozzle forming surface of the recording head and is elastically deformed, and it wipes the nozzle forming surface of the recording head. Accordingly, a sliding contact pressure of the wiping member against the nozzle forming surface of the recording head is varied in accordance with a degree of the adjustment by the platen gap adjusting device.

For example, when the platen gap is set to be large, the nozzle forming surface of the recording head is moved away from the wiping member. An amount of interference against the nozzle forming surface by the wiping member decreases, and a sliding contact pressure against the nozzle forming surface by the wiping member also decreases. For this reason, where the platen gap is set at a large value, an efficiency of wiping the nozzle forming surface by the wiping member decreases.

SUMMARY OF THE INVENTION

At an instant that the ink is wiped out from the nozzle forming surface of the recording head and the sliding contact of the wiping member with the nozzle forming surface is removed, the wiping member is elastically returned to its original position. During the elastically returning operation of the wiping member, the wiped ink is scattered within the recording apparatus. To reduce a degree of the ink scattering, there is proposed a recording apparatus employing a control unit which decreases a moving speed of the carriage (recording head) near the end of the wiping operation by the wiping member, whereby the ink scattering degree is reduced.

A degree of deformation (bending) of the wiping member, which is in a sliding contact with the nozzle forming surface, depends on a degree of the adjustment of the platen gap. Accordingly, the end of the wiping operation of the wiping member is substantially varied, and hence a position at which the wiping member starts the elastically returning operation, is also varied. For this reason, there is a desire to vary a position to start the low speed driving of the carriage in accordance with the size of the platen gap.

The present invention has been made to solve the technical problems as mentioned above, and an object of the invention is to provide an ink jet recording apparatus which stably wipes the nozzle forming surface with the wiping member independently of the adjustment of the platen cap, whereby the ink scattering caused by he wiping member is effectively reduced, and a method of controlling the operation of wiping a recording head in the ink jet recording apparatus.

According to one aspect of the present invention, there is provided a first ink jet recording apparatus comprising: an ink jet recording head having a nozzle forming surface mounted on a carriage to be reciprocatively moved for ejecting ink droplets in accordance with print data; a wiping member which comes in sliding contact with the nozzle forming surface with the movement of said recording head, thereby cleaning the nozzle forming surface; and a control unit for controlling a wiping speed of the wiping member relative to said nozzle forming surface, which is performed with the movement of said recording head; wherein the wiping speed is controlled in accordance with adjusting information of a platen gap adjusting device.

In the first ink jet recording apparatus, when the adjusting information of the platen gap adjusting device indicates that a platen gap is large, a speed of wiping the nozzle forming surface by the wiping member is preferably controlled so as to be lower than the wiping speed when the adjusting information of the platen gap adjusting device indicates that the platen gap is small.

In another ink jet recording apparatus, a control unit is provided which controls the number of operations of wiping the nozzle forming surface by the wiping member, which is performed with the movement of the recording head, in accordance with adjusting information of the platen gap adjusting device.

In the second ink jet recording apparatus, when the adjusting information of the platen gap adjusting device indicates that a platen gap is large, the number of operations of wiping the nozzle forming surface by the wiping member is controlled so as to be larger than the number of wiping operations when the adjusting information of the platen gap adjusting device indicates that the platen gap is small.

In a third ink jet recording apparatus constructed according to the invention, a control unit is provided which decreases a speed of wiping the nozzle forming surface by the wiping member, which is performed with the movement of the recording head, at a time point near the end of the wiping operation by the wiping member, and for varying a deceleration start position of the recording head in accordance with adjusting information of the platen gap adjusting device.

In the third ink jet recording apparatus, when the adjusting information of the platen gap adjusting device indicates that a platen gap is large, a deceleration start position of the recording head is controlled so as to be located on a side from which the recording head approaches to the wiping member as compared to a deceleration start position when the adjusting information of the platen gap adjusting device indicates that the platen gap is small. Also in this ink jet recording apparatus, a deceleration start position of the recording head is preferably controlled so as to be a range from a position out of a nozzle forming area of the recording head to the end of the nozzle forming surface is set to be a range of the wiping by the tip of the wiping member.

Additionally, the control of changing the deceleration start position is performed in a manner that a drive speed of a carriage motor is decreased in accordance with information output from an encoder for detecting a moving position of the recording head.

According to another aspect of the invention, there is provided a method of controlling the operation of wiping an ink jet recording head in an ink jet recording apparatus having an ink jet recording head, mounted on a carriage to be reciprocatively moved, for ejecting ink droplets in accordance with print data, and a wiping member which comes in sliding contact with a nozzle forming surface with the movement of the recording head, thereby cleaning the nozzle forming surface, the method comprising the steps of: acquiring adjusting information of a platen gap adjusting device; setting a speed of wiping the nozzle forming surface by the wiping member in accordance with platen gap adjusting information acquired in the gap adjusting information acquiring step; and wiping the nozzle forming surface by the wiping member by moving the recording head in accordance with a wiping speed set in the wiping speed setting step.

In another recording head wiping control method, the following steps are executed: a step of acquiring adjusting information of a platen gap adjusting device; a step of setting the number of reciprocating operations of the recording head in accordance with platen gap adjusting information acquired in the gap adjusting information acquiring step; and a step of wiping the nozzle forming surface by the wiping member by moving the recording head in accordance with the number of reciprocating operations as set in the number of reciprocating operations setting step.

In yet another recording head wiping control method, the following steps are executed: a step of acquiring adjusting information of a platen gap adjusting device; a step of setting a deceleration start position of the recording head in accordance with platen gap adjusting information acquired in the gap adjusting information acquiring step; and a step of decreasing a moving speed of the recording head in a state that the wiping member is in sliding contact with the nozzle forming surface, in accordance with a deceleration start position as set in the deceleration start position step.

In one recording apparatus using the wiping control method, gap adjustment information output from the platen gap adjusting device is utilized, and a speed of wiping the nozzle forming surface by the wiping member, which is performed with the movement of the recording head, is varied in accordance with the gap adjustment information. For example, when the platen gap is adjusted to be large, an amount of interference of the wiping member against the nozzle forming surface decreases, and hence a sliding contact pressure against the nozzle forming surface is decreased. Accordingly, an efficiency of wiping the nozzle forming surface by the wiping member decreases. However, the decrease of the wiping efficiency is compensated for by decreasing the wiping speed of the wiping member when it wipes the nozzle forming surface.

In another recording apparatus using the wiping control method, gap adjustment information output from the platen gap adjusting device is utilized, the number of operations of wiping the nozzle forming surface by the wiping member, which is performed with the movement of the recording head, is set in accordance with the gap adjustment information. For example, when the platen gap is adjusted to be large, an amount of interference of the wiping member against the nozzle forming surface decreases as in the case mentioned above, and hence a sliding contact pressure against the nozzle forming surface is decreased. However, the wiping effect by the wiping member may be increased by executing the wiping operations plural times.

In yet another recording apparatus using the wiping control method, gap adjustment information output from the platen gap adjusting device is utilized, the deceleration start position of the recording head is varied in accordance with the gap adjustment information. In this case, a deceleration start position of the recording head is controlled so as to be set at an early position in the moving direction of the recording head or at a position in the advancing direction in accordance with the size of the platen gap. With the control, the deceleration start position of the recording head may be set at a position just before the end of the wiping operation of the wiping member. The scattering of the ink from the wiping member is effectively reduced.

In other words, a decelerating movement range of the recording head may be reduced by controlling the deceleration start position of the recording head in accordance with the platen gap. When the wiping member passes the end of the wiping operation, the recording head may be quickly moved to the print area. Accordingly, this feature substantially increases the through-put of the recording apparatus.

DETAILED DESCRIPTION OF THE PREFERRED EMBODIMENTS

Figure 1:
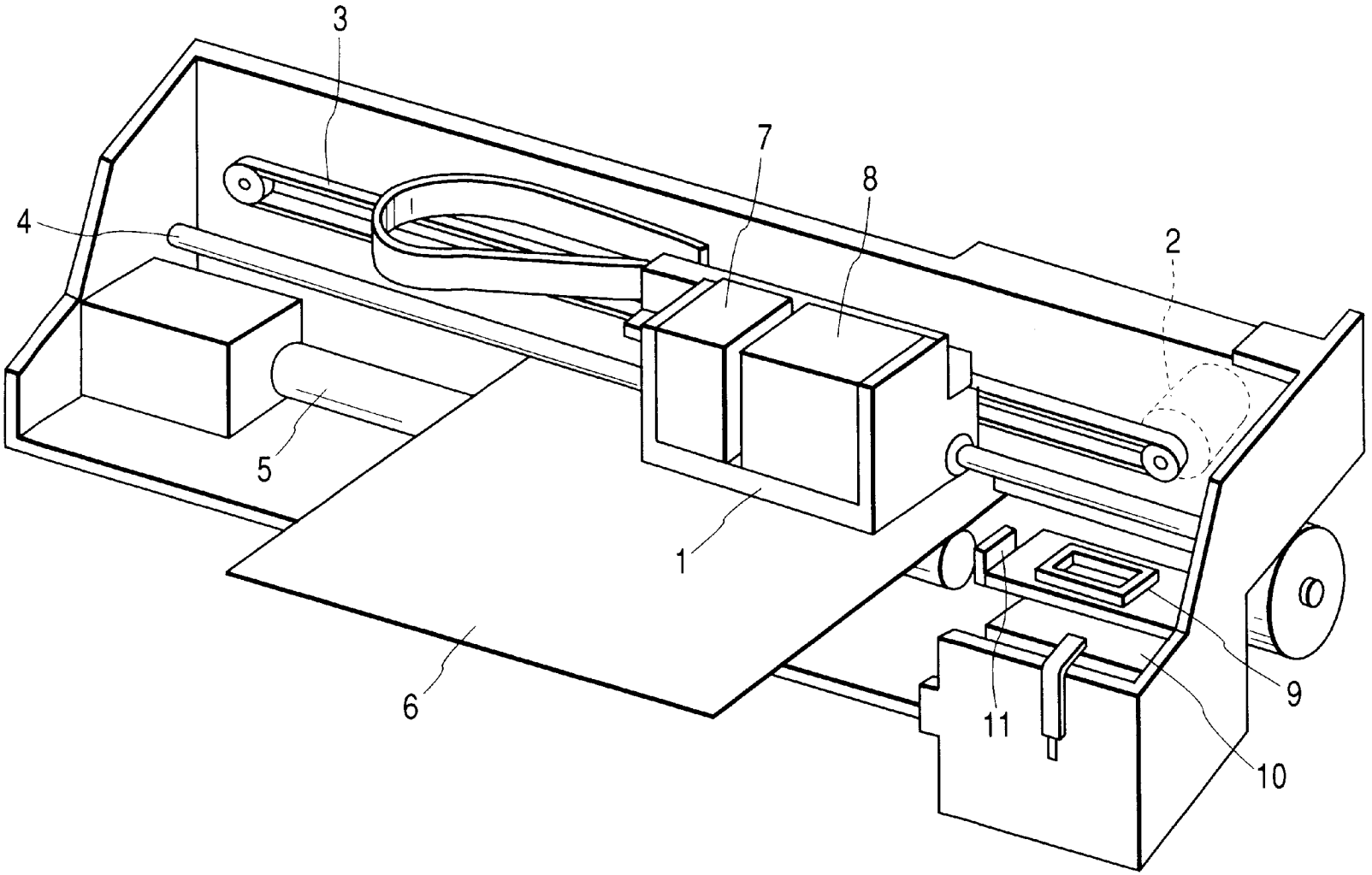
FIG. 1 is a diagram showing a basic mechanical arrangement of an ink jet recording apparatus incorporating the invention.

The preferred embodiments of the present invention will be described with reference to the accompanying drawings. FIG. 1 is a diagram showing a basic mechanical arrangement of an ink jet recording apparatus incorporating the invention. In FIG. 1, reference numeral 1 designates a carriage. The carriage 1 is reciprocatively moved in the axial direction of a platen 5 while being guided by a guide member 4, with the aid of a timing belt 3 driven by a carriage motor 2.

An ink jet recording head to be described later (not shown in FIG. 1) is mounted on the surface (lower side surface) of the carriage 1 which faces a recording sheet 6. A nozzle forming surface of the ink jet recording head is confronted with the recording sheet 6, while being spaced from each other by a small gap. A black ink cartridge 7 and a color ink cartridge 8, which supply inks to the recording head, are detachably loaded to the upper part of the carriage 1. In the embodiment, the ink is supplied from each cartridge to the recording head.

In the figure, reference numeral 9 is a capping device disposed in a non-print area (referred to as a home position). When the recording head mounted on the carriage 1 moves to a position directly above the capping device, the capping device is elevated and sealingly caps the nozzle forming surface of the recording head. A suction pump 10 for applying a negative pressure to the inner space of the capping device 9 is disposed at a location adjacent to the capping device 9.

The capping device 9 serves as a lid which prevents the nozzle orifices of the recording head from drying during the rest time of the recording apparatus, and also functions as a cleaning unit to perform such an operation as to apply a negative pressure caused by the suction pump 10 to the recording head, and to suck ink from the recording head and discharge it outside.

A wiping member 11, which is shaped like a strip and made of rubber material, is located adjacent to the print area adjacent to the capping device 9 in a state that it is horizontally and retractively movable. When the carriage 1 is reciprocatively moved to the capping device 9 side, the wiping device wipes the nozzle forming surface of the recording head in accordance with the necessity. With this feature, the ink attaching to the nozzle forming surface is wiped out from the nozzle forming surface after the cleaning operation, for example. It is prevented that ink drips off from the recording head to stain the recording sheet or the like.

Figure 2:
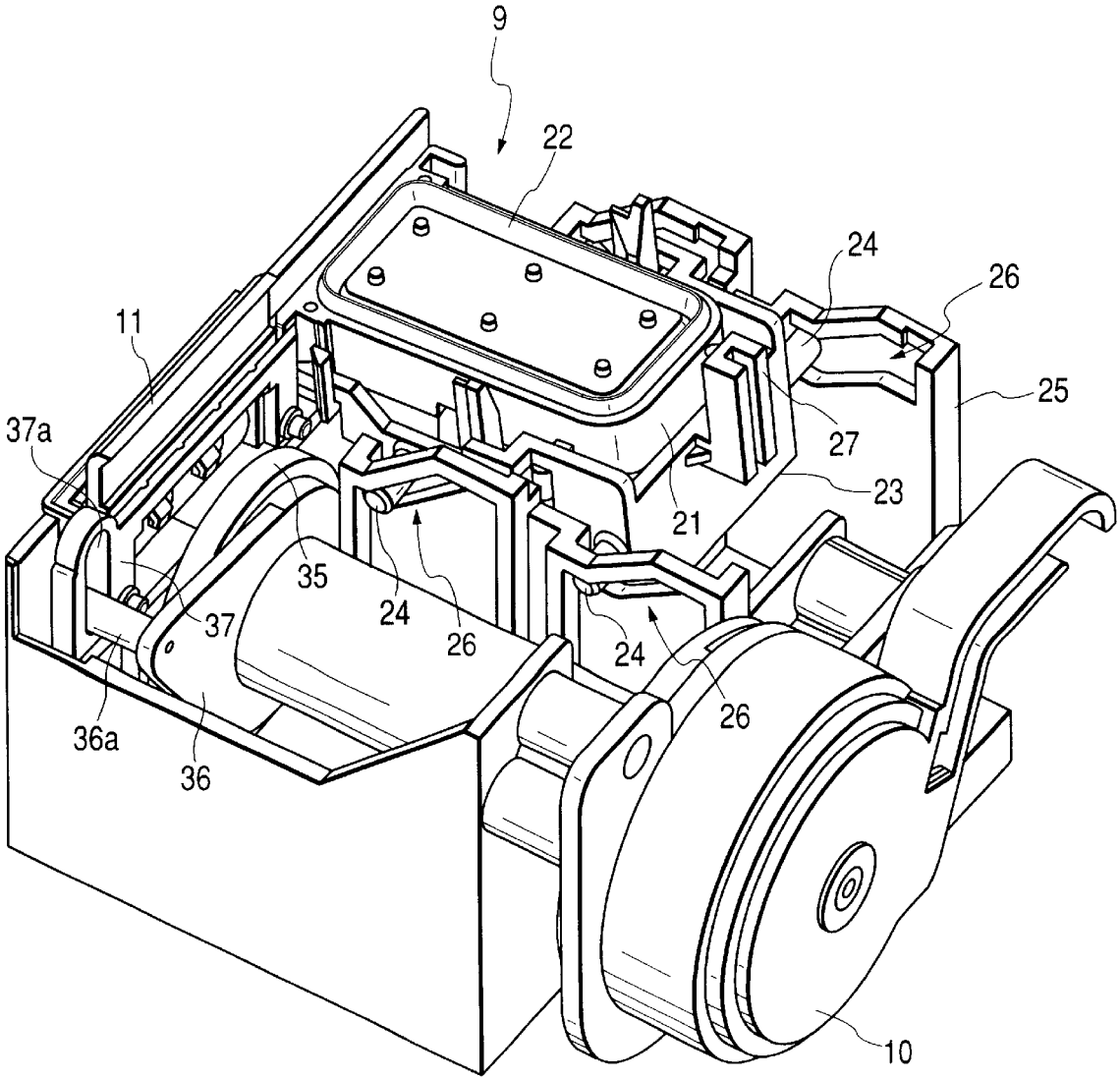
FIG. 2 is a perspective view showing the unit construction containing a capping device drive mechanism mounted on the FIG. 1 recording apparatus and others.
Figure 3:
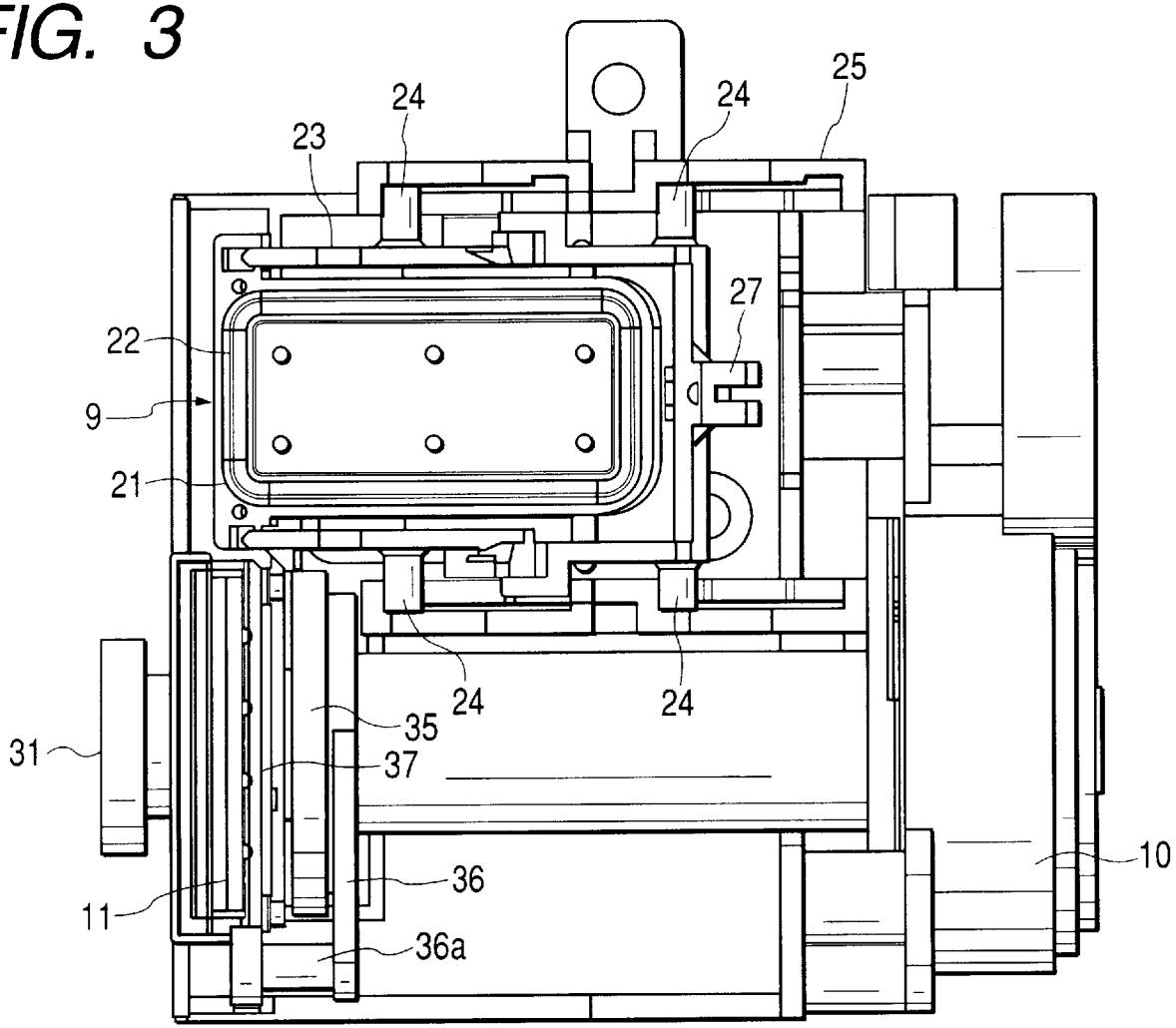
FIG. 3 is a plan view showing the same.

FIGS. 2 and 3 are diagrams showing a state that a driving mechanism for the capping device 9 mounted on the recording apparatus, the tube pump 10 serving as a suction pump, and a driving mechanism for the wiping member 11 are assembled into a single unit. FIG. 2 is a perspective view showing the unit construction containing them, and FIG. 3 is a plan view showing the same.

The capping device 9 capable of hermetically capping the nozzle forming surface of the recording head is provided with a cap holder 21 which is rectangular in shape. A cap member 22 made of flexible material, e.g., elastomer, is formed on the peripheral edge of the opening of the cap holder 21. The nozzle forming surface of the recording head is sealingly capped with the cap member 22.

The cap holder 21 is mounted on a slider 23 forming a lifting mechanism. A plurality of guide members 24, while extending horizontally, is formed on the slider 23. The guide members 24 are respectively located in elongated inclined holes 26 formed in a frame member 25, which slides and supports the slider 23. An engaging protrusion 27, while standing erect, is formed integral with the slider 23. The engaging protrusion 27 functions to perform an operation as to move the slider 23 in the moving direction of the carriage 1 in a manner that when the carriage 1 moves to the home position, it is pressed with a contact member 1*a* to be given later (see FIGS. 5A and 5B) located at the end part of the carriage 1.

Accordingly, with the movement of the carriage 1 toward the home position, the guide members 24 formed on the slider 23 slide up along the elongated inclined holes 26 formed in the frame member 25. As a result, the nozzle forming surface of the recording head mounted on the carriage 1 is sealingly capped with the cap member 22 formed on the cap holder 21. When the carriage 1 is moved to the print area side, the slider 23 moves to the print area side while being urged by a return spring (not shown), thereby removing the sealing of the nozzle forming surface of the recording head by the cap member 22.

An ink discharge port is formed extending from the inner bottom part to the lower surface of the cap holder 21, although it is not illustrated in FIGS. 2 and 3. The ink discharge port is connected to a tube, which forms the suction side of the tube pump 10 as suction pump already stated. The tube pump 10 generates a negative pressure by progressively crushing the arcuately arranged, flexible tube by a roller. When a driving wheel 31 shown in FIG. 3 is driven to rotate in one direction, the tube pump performs its pumping operation. When it is rotated in the other direction, the tube pump is put in a released state. In the embodiment, the driving wheel 31 receives a drive force of a sheet feeding motor, which is for loading and discharging the recording sheet 6, through a train of reduction gears, and is driven by the drive force.

Accordingly, the negative pressure may be applied to the nozzle forming surface of the recording head in a manner that the tube pump 10 is driven in a state that the nozzle forming surface is hermetically closed with the cap member 22 forming the capping device 9. Under the negative pressure, the ink is sucked from the recording head, and discharged outside. The sealing of the nozzle forming surface by the cap member 22 is removed by somewhat moving the carriage 1 to the print area side. In this state, the tube pump 10 is driven again, and then waste ink as discharged into the capping device 9 is fed to a waste ink tank to be described later, via the tube pump 10.

A cam like member 36 is rotated with the aid of a clutch plate 35 driven with the rotation of the driving wheel 31. The cam like member 36 is pressed against the clutch plate 35 by a spring member (not shown), and is driven to rotate within a predetermined range of rotation angle while being dragged in the rotation direction of the clutch plate 35. A driving pin 36*a,* shaped like a cylindrical pole, is attached to the cam like member 36, while extending in the horizontal direction.

The wiping member 11, while standing erect, is supported on the upper part of a wiper holder 37 that is horizontally movable. A groove hole 37*a* is vertically formed in the wiper holder 37. The driving pin 36*a,* shaped like a cylindrical pole, is inserted into the groove hole 37*a*. The driving pin 36*a,* which is moved by the friction clutch made up of the clutch plate 35 and the cam like member 36, while tracing an arcuate path, thereby moves the wiper holder 37, slides in the groove hole 37*a* vertically formed in the wiper holder 37 to move the wiper holder 37 in the horizontal direction. A state shown in FIGS. 2 and 3 is a reset state of the wiping member 11 disposed on the upper part of the wiper holder 37, which has been retracted from the traveling path of the recording head.

In the embodiment, the tube pump 10 performs pump action as the result of the rotating of the sheet feeding motor in one direction. In an early stage of this rotating operation, the wiper holder 37 is driven to move in the horizontal direction by the friction clutch, and the wiping member 11 advances to the traveling path of the recording head, viz., it is put in a set state. At this time, when the recording head moves in the main scan direction, the nozzle forming surface thereof is wiped by the wiping member 11. The tube pump 10 is put in a release state when the sheet feeding motor is rotated in the other direction. In an early stage of the rotating operation, the wiper holder 37 is driven to move in the horizontal direction by the friction clutch, and the wiping member 11 is retracted from the traveling path of the recording head and put in a reset state.

Figure 4:
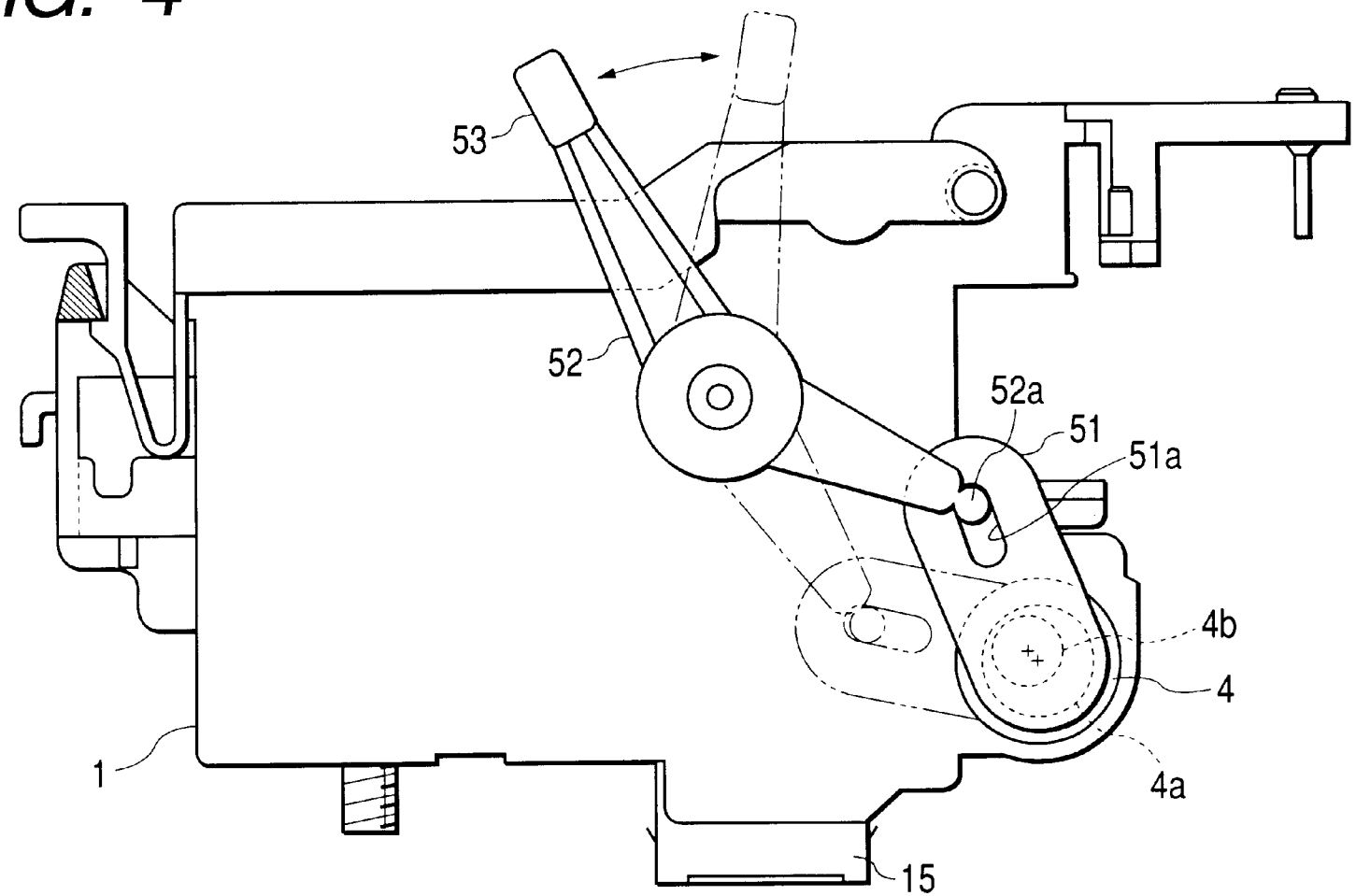
FIG. 4 is a side view showing an instance of a platen gap adjusting device mounted on the recording apparatus.

FIG. 4 shows an arrangement of the platen gap adjusting device mounted on the recording apparatus mentioned above. As shown in FIG. 4, the carriage 1 is moved in the direction perpendicular to a paper surface of the FIG. 4, while being guided by the guide member 4. An intermediate shaft 4*a* is rotatably located within the guide member 4, and is supported by an eccentric shaft 4*b,* which is pivotally supported on the right and left frames in the recording apparatus at the right and left ends as viewed in the longitudinal direction. An operation lever 51 having a sliding groove 51*a* is coupled to the intermediate shaft 4*a*. A sliding member 52*a,* which is located at the driven end of an operation lever 52 whose center part is pivotally supported on the frames, is slidably inserted into the sliding groove 51*a* formed in the operation lever 51.

An operation member 53 capable of turning the operation lever is attached to the operating end of the operation lever 52. By turning the operation lever 52 in the direction of an arrow by using the operation member 53, the carriage 1 having a recording head 15 is vertically movable. Specifically, in the embodiment, when the operation lever 52 is pulled to this side (rotated counterclockwise in FIG. 4) as indicated by sold lines, the operation lever 51 is rotated clockwise in FIG. 4, and accordingly the carriage is somewhat lowered through the action of the eccentric shaft 4*b*. As a result, the recording head 15 is moved downward, and the gap between the recording head and the platen 5 shown in FIG. 1 is reduced.

When the operation lever 52 is turned to be put upright as indicated by chain lines, the operation lever 51 is rotated counterclockwise in the figure, and the carriage lifts up by the action of the eccentric shaft 4*b*. And the recording head 15 moves upward, and the gap between the recording head and the platen 5 shown in FIG. 1 is increased.

Figure 5A:
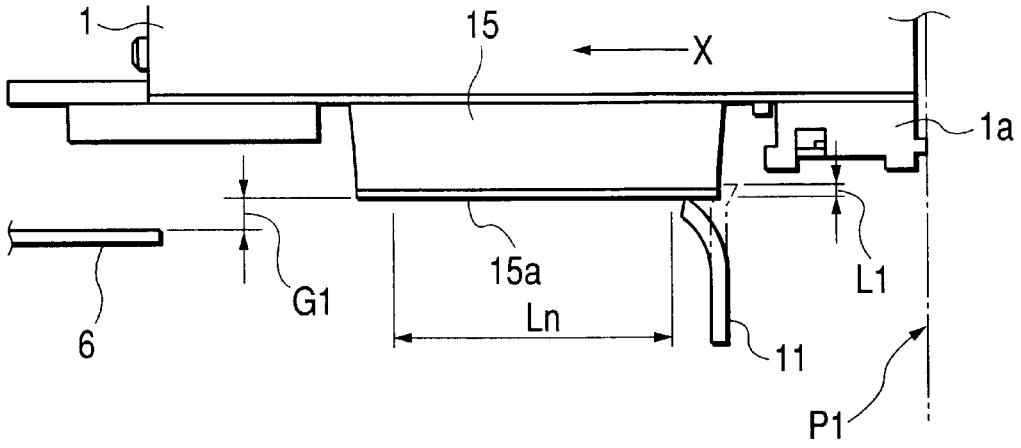
FIGS. 5A and 5B are diagrams for explaining a wiping operation.
Figure 5B:
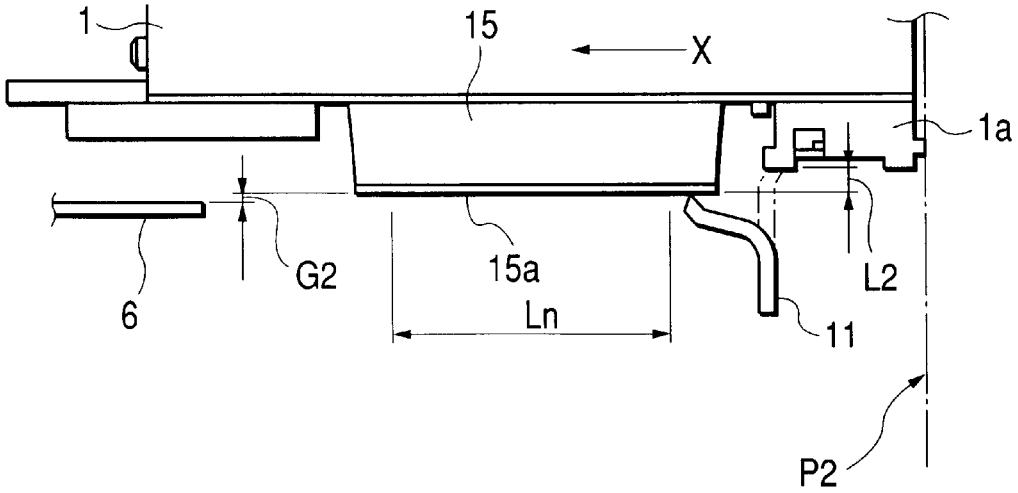

FIGS. 5A and 5B are diagrams for explaining an operation of the wiping member 11, which is brought into sliding contact with a nozzle forming surface 15*a* of the recording head 15 when the platen gap adjusting device is operated. FIG. 5A shows a case where the platen gap is large, and FIG. 5B shows a case where the platen gap is small. In either case, the carriage 1 is moved in the direction of an arrow "X", and the wiping operation is performed.

As seen from the FIGS. 5A and 5B, when the platen gap adjusting device is operated so that the platen gap (G1 in the figures) is large, a distance of the nozzle forming surface 15*a* of the recording head relative to the wiping member 11 increases. An amount of interference (L1) of the wiping member 11 with the nozzle forming surface 15*a* is small. A sliding contact pressure of the wiping member 11 to the nozzle forming surface 15*a* decreases, and the wiping efficiency of the wiping member 11 when it wipes the nozzle forming surface 15*a* decreases. When the platen gap is made to be small (G2 in the figure), a distance between the nozzle forming surface 15*a* and the wiping member 11 is reduced. An amount of interference (L2) of the wiping member 11 with the nozzle forming surface 15*a* is large. Accordingly, the sliding pressure of the wiping member 11 to the nozzle forming surface 15*a* increases.

Also, when the platen gap is controlled to be small, the tip of the wiping member 11 is greatly deformed by its operation of wiping the nozzle forming surface 15*a,* so that the tip is moved in the direction of the arrow X in which the carriage 1 moves. Accordingly, the carriage 1 further moves in the X direction, and the tip of the wiping member 11 is spaced apart form the end of the nozzle forming surface 15*a*. This position of the wiping member is the end of the wiping operation. At the end of the wiping operation, in the case of FIG. 5B, the position of the recording head (the carriage) is shifted closer to the print area side (left side in FIGS. 5A and 5B) than in the case of FIG. 5A.

In the recording apparatus of the embodiment, a speed of wiping the nozzle forming surface 15*a* by the wiping member 11, which is performed with the movement of the recording head, is controlled to be decreased near the end of the wiping operation by the wiping member. By this control, a degree of the ink scattering caused by the elastically returning of the wiping member 11 is effectively reduced. In this case, it is preferable to perform the wiping operation at a constant speed in the range of a nozzle forming position "Ln" on the nozzle forming surface 15*a*. Further, it is preferable that the decelerating operation is performed within a range from a position out of the nozzle forming position Ln to the end of the nozzle forming surface.

However, the end of the wiping operation at which the tip of the wiping member 11 leaves the end of the nozzle forming surface 15*a,* varies in accordance with the size of the platen gap. Generally, when the deceleration position is fixed, the deceleration of the recording head sometimes starts in a state that the wiping member 11 is in sliding contact with the nozzle forming surface within the nozzle forming range Ln or the tip of the wiping member leaves the end of the nozzle forming surface 15*a* before the deceleration starts. Accordingly, when the deceleration position is fixed, a problem of scattering much ink generally arises.

Figure 6:
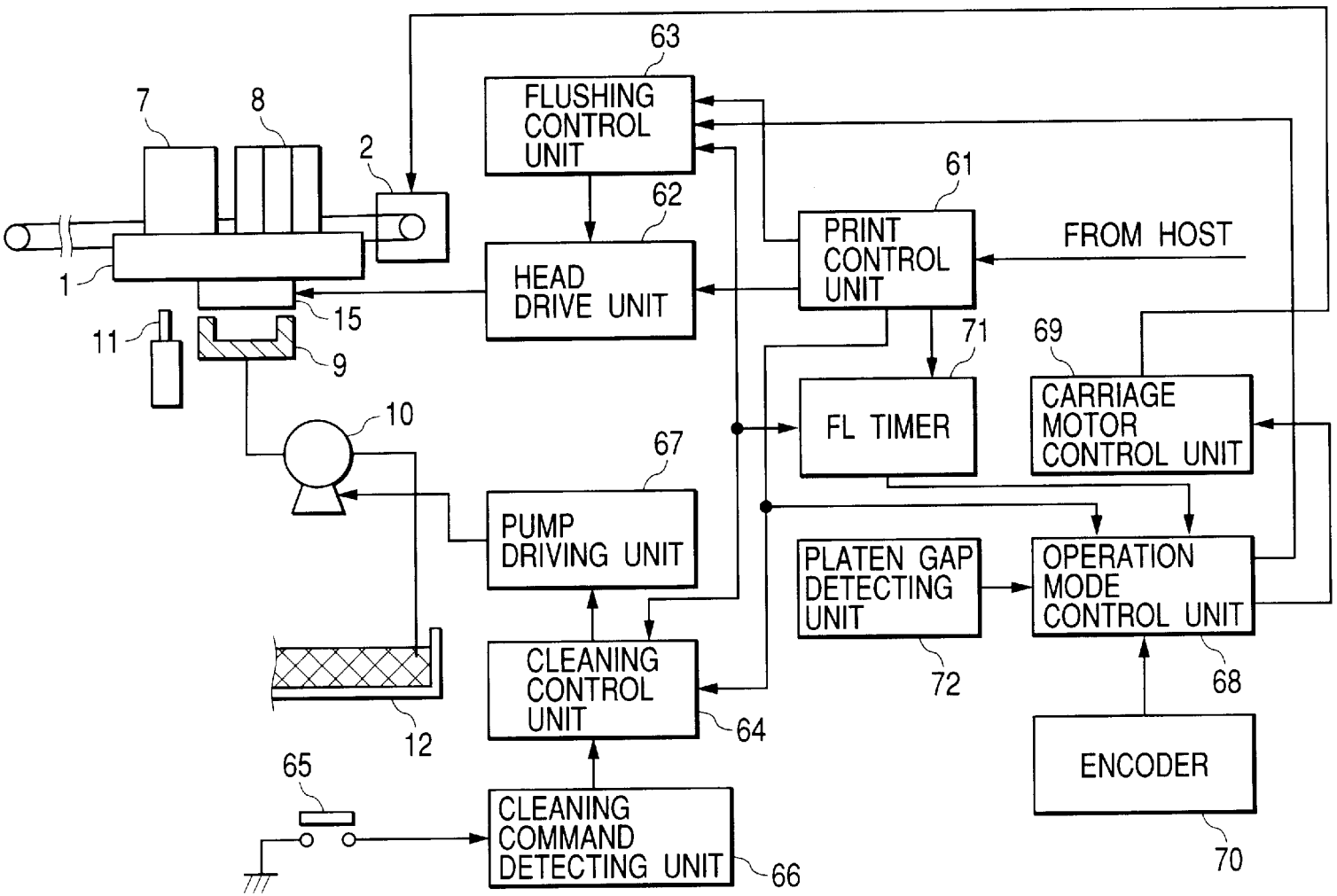
FIG. 6 is a block diagram showing a control unit mounted on the recording apparatus.

FIG. 6 is a block diagram showing a control circuit, which compensates for the decrease of the wiping efficiency of the nozzle forming surface by the wiping member, which is caused when the amount of interference L1 of the wiping member with the nozzle forming surface is small, and decelerates the carriage at a position just before the end of the wiping operation where the tip of the wiping member leaves the end of the nozzle forming surface.

In FIG. 6, the following portions will be designated by like numerals: the carriage 1, the carriage motor 2, the ink cartridges 7 and 8, the capping device 9, the suction pump 10, and the wiping member 11. As shown in FIG. 6, the suction pump 10 is connected to the capping device 9, and the discharge side of the suction pump 10 is connected to a waste ink tank 12.

In FIG. 6, reference numeral 61 is a print control unit. The print control unit 61 generates bit map data based on print data output from a host computer. A head drive unit 62 generates drive signals based on the bit map data, and causes the recording head 15 mounted on the carriage 1 to eject ink droplets. The head drive unit 62 receives a flushing command signal from a flushing control unit 63 in addition to the drive signal based on the print data, and outputs a drive signal for the flushing operation to the recording head 15.

Reference numeral 64 designates a cleaning control unit. The cleaning control unit 64 performs a cleaning operation in response to a command signal derived from a cleaning command detecting unit 66 when a cleaning command switch 65 located on an operation panel is turned on. Also when receiving a cleaning command signal from the host computer via the print control unit 61, the cleaning control unit 64 also performs the cleaning operation.

When it receives the cleaning command signal, the cleaning control unit 64 controls a pump driving unit 67 to drive the suction pump 10. By the driving operation of the suction pump 10, the negative pressure is applied to the inner space of the capping device 9. Then, it sucks the ink and discharges it from the nozzle orifices of the recording head. When the suction pump 10 is driven again in a state that the sealing of the nozzle forming surface by the capping device 9 is removed, the waste ink discharged into the inner space of the capping device 9 is cast into the waste ink tank 12.

A control signal is sent from the print control unit 61 to the operation mode control unit 68. The operation mode control unit 68 sends a control signal to the carriage motor control unit 69, thereby executing the drive control of the carriage motor 2. A signal is supplied from the encoder 70 to the operation mode control unit 68.

The encoder 70 has a function to detect a moving position of the carriage, for example, optically. To this end, a number of optical slits (not shown) are arranged in the moving direction of the carriage. With the scan movement of the carriage, the number of interruptions of light passing through the slits is counted up, to thereby detect a moving position of the carriage.

A control signal is sent from a flushing timer (FL timer) 71 to the operation mode control unit 68. When the printing operation continues for a predetermined time (e.g., 10 seconds) during the printing operation, the flushing timer 71 sends a control signal to the operation mode control unit 68. In turn, the operation mode control unit 68 sends a control signal to the carriage motor control unit 69, to move the carriage 1 to a flushing position. The flushing timer 71 sends a control signal to the flushing control unit 63, and in turn the flushing control unit 63 sends a flushing control signal to the head drive unit 62.

Platen gap information is transferred from the platen gap detecting device 72 to the operation mode control unit 68. In the embodiment, information indicative of the size of the platen gap is transferred to the operation mode control unit 68. Accordingly, a micro-switch (not shown) is on/off controlled in accordance with an operation position of the operation lever 52 shown in FIG. 4. An electrical signal representative of binary information derived from the micro-switch is supplied to the operation mode control unit 68.

The operation mode control unit 68 sends a command signal to the carriage motor control unit 69 by the utilization of platen gap information and carriage (recording head) position information derived from the carriage motor control unit 69, whereby a control of changing a wiping speed and a control of changing the number of wiping operations, which will be described subsequently. The operation mode control unit 68 sends a control command for decelerating the scanning speed of the carriage 1 to the carriage motor control unit 69 at an appropriate position corresponding to the platen gap, thereby controlling the changing of the carriage deceleration position during the wiping operation.

1. Control of Changing the Wiping Speed

The operation mode control unit 68 acquires platen gap information from the platen gap detecting device 72 (platen gap information acquiring step), and sends a command signal on a moving speed of the carriage to the carriage motor control unit 69 (wiping speed setting step). The operation mode control unit 68 refers to the carriage position information from the encoder 70, and at a position where the wiping operation is executed, sends a control signal to the carriage motor control unit 69 with an intention that an optimum wiping speed is set up corresponding to the platen gap (wiping step), In this case, when the platen gap is large, a moving speed of the carriage, which moves from the home position to the print area, is controlled to be lower than that when the platen gap is small. In an example, when the platen gap is large, the moving speed of the carriage is set at 40 cps (character/sec). When the platen gap is small, the moving speed of the carriage is set at 80 cps (character/sec). As the result of such a control, when the platen gap is large, an amount of interference of the wiping member with the recording head is small. Accordingly, the wiping efficiency of the wiping member when it wipes the nozzle forming surface is likely to be low. However, the wiping performance may be improved by making the wiping operation slow.

2. Control of Changing the Number of Wiping Operations

The operation mode control unit 68 acquires platen gap information from the platen gap detecting device 72 (platen gap information acquiring step), and sets the number of reciprocating operations of the recording head in accordance with platen gap adjusting information acquired (number of reciprocating operations setting step). The operation mode control unit 68 refers to the carriage position information from the encoder 70, and at a position where the wiping operation is executed, reciprocatively moves the recording head in accordance with the number of reciprocating operations already set, whereby the nozzle forming surface of the recording head is wiped with the wiping member (wiping step).

In executing the control of changing the number of wiping operations, a control signal is sent to the cleaning control unit 64 by the operation mode control unit 68, and the operations of setting and resetting the wiping member 11 are also performed at the same time. As the result of the control, when the recording head 15 is moved from the home position to the print area, the wiping member 11 is set, and the wiping of the nozzle forming surface by the wiping member 11 is performed.

In this case, when the platen gap is large, the number of wiping operations is controlled to be larger than that when it is small. In a specific example, when the platen gap is large, the number of wiping operations is set to be two, and when the platen gap is small, the number of wiping operations is set to be one. In such a control, when the platen gap is large, an amount of interference of the wiping member with the recording head is small. Accordingly, the wiping efficiency of the wiping member when it wipes the nozzle forming surface is likely to be low. However, since the wiping operation is repeated plural times, the wiping performance may be improved.

3. Control of Changing a Carriage Deceleration Position During the Wiping Operation The operation mode control unit 68 acquires platen gap information from the platen gap detecting device 72 (platen gap information acquiring step), and sets a deceleration position of the recording head in accordance with platen gap adjusting information acquired (deceleration start position setting step). The operation mode control unit 68 refers to the carriage position information from the encoder 70, and sends a control command to the carriage motor control unit 69 to thereby decelerate the carriage motor 2 when the carriage 1 reaches a deceleration start position already set. As the result of the control, the recording head being in sliding contact with the nozzle forming surface may be decelerated (deceleration control step).

FIGS. 5A and 5B show how the deceleration control is performed. As shown, when the platen gap is large, the end of the contact member 1*a* located on the carriage 1, as shown in FIG. 5A, moves to a position P1, and at this time the recording head is decelerated. As the result of the deceleration control, a deceleration start position is set, with a range of wiping a range from a position at which the tip of the wiping member 11 is out of the nozzle forming area Ln of the recording head to the end of the nozzle forming surface 15*a*.

Where the platen gap is small, the recording head is decelerated when the end of the contact member 1*a* is moved to a position P2 as shown in FIG. 5B. That is, where the platen gap is small, the wiping member 11 has been greatly deformed. In other words, as compared to the deceleration start position P2, the deceleration start position P1 is located on a side from which the recording head 15 approaches to the wiping member 11. However, by shifting the deceleration start position to the advancing direction of the recording head, viz., a position P, the decelerating operation is made to start within a range of the wiping by the tip of the wiping member 11, which the range extends from a position out of the nozzle forming area Ln of the recording head to the end of the nozzle forming surface 15*a*.

Through the deceleration control mentioned above, at an instance that the tip of the wiping member 11 leaves the nozzle forming surface 15*a* of the recording head, the recording head is sure to be put in a deceleration state, so that a degree of scattering of ink from the wiping member 11 is reduced. By executing the deceleration control, the deceleration movement range of the recording head may also be reduced. When the wiping member passes the end of the wiping operation, the recording head may be moved to the print area quickly. Accordingly, this feature substantially increases the through-put of the recording apparatus.

In the embodiment mentioned above, to obtain the size of the platen gap, a micro-switch is used which is on/off controlled depending on an operation position of the operation lever 52 shown in FIG. 4. Where the binary information obtained by using the micro-switch is utilized for obtaining the platen gap size information, no problem arises in practical use. Information may be used instead which is produced by, for example, a rotary encoder which produces an electrical signal linearly varying in accordance with a rotation angle of the operation lever 52 shown in FIG. 4. In this case, the wiping speed, the number of wiping operations, and the carriage deceleration position may be controlled in a multiple of steps in accordance with a degree of the platen gap adjustment.

As seen from the foregoing description, in an ink jet recording apparatus using a method of controlling the operation of wiping a recording head in the ink jet recording apparatus, which is constructed according to the invention, a stable wiping effect by the wiping member is ensured regardless of the platen gap adjustment. Further, the scattering of the ink by the wiping member is effectively reduced.

What is claimed is:

1. An ink jet recording apparatus comprising:

an inkjet recording head having a nozzle forming surface mounted on a carriage to be reciprocatively moved for ejecting ink droplets in accordance with print data;

a wiping member which comes in sliding contact with the nozzle forming surface with a movement of said recording head, thereby cleaning the nozzle forming surface; and a control unit for controlling a wiping speed of the wiping member relative to said nozzle forming surface, which is performed with the movement of said recording head;

wherein the wiping speed is controlled in accordance with adjusting information of a platen gap adjusting device.

2. An ink jet recording apparatus according to claim 1, wherein when the adjusting information of said platen gap adjusting device indicates that a platen gap is large, the wiping speed is controlled so as to be lower than the wiping speed when the adjusting information of said platen gap adjusting device indicates that the platen gap is small.

3. An ink jet recording apparatus comprising:

an ink jet recording head having a nozzle forming surface mounted on a carriage to be reciprocatively moved for ejecting ink droplets in accordance with print data;

a wiping member which comes in sliding contact with the nozzle forming surface with a movement of said recording head, thereby cleaning said nozzle forming surface; and a control unit for controlling a number of wiping operations to said nozzle forming surface by said wiping member, which is performed with the movement of said recording head;

wherein said number of wiping operations is controlled in accordance with adjusting information of said platen gap adjusting device.

4. An ink jet recording apparatus according to claim 3, wherein when the adjusting information of said platen gap adjusting device indicates that a platen gap is large, the number of wiping operations is controlled so as to be larger than the number of wiping operations when the adjusting information of said platen gap adjusting device indicates that the platen gap is small.

5. An ink jet recording apparatus comprising:

an ink jet recording head mounted on a carriage to be reciprocatively moved for ejecting ink droplets in accordance with print data;

a wiping member which comes in sliding contact with a nozzle forming surface with a movement of said recording head, thereby cleaning said nozzle forming surface;

a control unit for controlling a wiping speed of said wiping member with respect to said nozzle forming surface, which is performed with the movement of said recording head, wherein the wiping speed is decreased at an area near an end of a wiping operation, and a deceleration start position of said recording head in the wiping speed varies in accordance with adjusting information of a platen gap adjusting device.

6. An ink jet recording apparatus according to claim 5, wherein when the adjusting information of said platen gap adjusting device indicates that a platen gap is large, the deceleration start position of said recording head is controlled so as to be located on a side from which the recording head approaches to the wiping member as compared to a position at which the deceleration start position is located when the adjusting information of said platen gap adjusting device indicates that the platen gap is small.

7. An ink jet recording apparatus according to claim 5, wherein the deceleration start position of said recording head is controlled so as to be located in a portion where a tip end of said wiping member wipes in an area between a boundary of a nozzle forming area on said nozzle forming surface and an outer end of said nozzle forming surface.

8. An ink jet recording apparatus according to claim 5, wherein said deceleration start position of the recording head is controlled in a manner that a drive speed of a carriage motor is decreased in accordance with information output from an encoder which detects a moving position of said recording head.

9. A method of controlling the operation of wiping an ink jet recording head in an ink jet recording apparatus having an ink jet recording head, mounted on a carriage to be reciprocatively moved, for ejecting ink droplets in accordance with print data, and a wiping member which comes in sliding contact with a nozzle forming surface with the movement of said recording head, thereby cleaning said nozzle forming surface, said method comprising the steps of:

acquiring a platen gap adjusting information from a platen gap adjusting device;

setting a wiping speed of said wiping member with respect to the nozzle forming surface in accordance with the platen gap adjusting information; and wiping said nozzle forming surface by said wiping member by moving said recording head in accordance with the wiping speed.

10. A method of controlling a wiping operation for an ink jet recording head in an ink jet recording apparatus having an ink jet recording head mounted on a carriage to be reciprocatively moved, for ejecting ink droplets in accordance with print data, and a wiping member which comes in sliding contact with a nozzle forming surface with the movement of said recording head, thereby cleaning a nozzle forming surface, said method comprising the steps of:

acquiring a platen adjusting information of a platen gap adjusting device;

setting the number of reciprocating operations of said recording head in accordance with the platen gap adjusting information; and wiping said nozzle forming surface by said wiping member by moving said recording head in accordance with the number of reciprocating operations.

11. A method of controlling a wiping operation for an ink jet recording head in an ink jet recording apparatus having an ink jet recording head, mounted on a carriage to be reciprocatively moved, for ejecting ink droplets in accordance with print data, and a wiping member which comes in sliding contact with a nozzle forming surface with the movement of said recording head, thereby cleaning said nozzle forming surface, said method comprising the steps of:

acquiring a platen gap adjusting information of a platen gap adjusting device;

setting a deceleration start position of said recording head in accordance with the platen gap adjusting information acquired in said gap adjusting information acquiring step; and decreasing a moving speed of said recording head in a state that said wiping member is in sliding contact with said nozzle forming surface, in accordance with the deceleration start position.

* * * * *